US010137339B1

(12) United States Patent
Forshner et al.

(10) Patent No.: US 10,137,339 B1
(45) Date of Patent: Nov. 27, 2018

(54) GOLF CLUB HAVING REMOVABLE FACE

(71) Applicant: Acushnet Company, Fairhaven, MA (US)

(72) Inventors: Steven J. Forshner, Vista, CA (US); Scott A. Knutson, Escondido, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/858,358

(22) Filed: Dec. 29, 2017

(51) Int. Cl.
*A63B 53/04* (2015.01)

(52) U.S. Cl.
CPC .... *A63B 53/047* (2013.01); *A63B 2053/0416* (2013.01)

(58) Field of Classification Search
CPC ..... A63B 53/047
See application file for complete search history.

(56) References Cited

U.S. PATENT DOCUMENTS 1,349,805 A 8/1920 Booth
4,540,178 A 9/1985 Johnson et al.
4,573,685 A * 3/1986 Young, IV ..... A63B 53/04 473/250
5,346,213 A 9/1994 Yamada
5,509,660 A * 4/1996 Elmer ..... A63B 53/04 473/288
6,080,068 A 6/2000 Takeda
7,604,550 B1 * 10/2009 Currie ..... A63B 53/047 473/342
7,651,413 B1 * 1/2010 Chen ..... A63B 53/0475 473/342
8,491,405 B2 7/2013 Jorgensen et al.
8,740,719 B2 * 6/2014 Wahl ..... A63B 53/047 473/288
8,876,624 B2 * 11/2014 Ban ..... A63B 53/047 473/288
2006/0052184 A1 * 3/2006 Soracco ..... A63B 53/047 473/345
2013/0090181 A1 * 4/2013 Boyd ..... A63B 53/04 473/288

* cited by examiner

*Primary Examiner* — Michael Dennis
(74) *Attorney, Agent, or Firm* — Michael J. Mancuso

(57) ABSTRACT

The present invention is directed to a modular golf club. In particular, golf club includes a face component that is removably coupled so that the physical attributes of the golf club head may be altered.

20 Claims, 4 Drawing Sheets

GOLF CLUB HAVING REMOVABLE FACE

FIELD OF THE INVENTION

This invention generally relates to golf clubs, and more specifically to a golf club having a removable face component.

BACKGROUND OF THE INVENTION

Iron-type golf clubs generally include a face that includes a ball striking surface and a body that supports the face, provides desired mass properties and includes a sole that is configured to contact the ground during a swing. The face includes a ball striking surface that generally includes a plurality of score lines or grooves that are positioned to impart spin to the ball during impact. Through repeated use, the score lines are known to wear, such as by dulling the edges of the score lines, thereby reducing the resultant spin imparted to the ball. The body is generally designed to provide mass that is distributed to tailor the behavior of the club, especially during impact with the ball.

Each golfer has a unique swing. It is impossible to design a golf club that is perfectly suited to every golfer. However, golf club designers are forced to provide a limited number of models that are intended to suffice for the majority of golfers. Typically, the construction of the golf club, especially for iron-type golf clubs, includes a single structural component that includes the body, the face, the sole and a hosel. In multi-material constructions, the parts of the golf club head are formed separately and then coupled during manufacturing of the club head, and the components are generally permanently coupled.

Some prior golf clubs have utilized multi-component constructions. For example, U.S. Pat. No. 5,346,213 describes a golf club head that includes a metal head body and a fiber reinforced resin face plate. A support pin extends through the body and retains the face plate.

In another multi-component golf club head construction, shown in U.S. Pat. No. 6,080,068, a golf club head includes a head attachment portion at the rear of a face that is horizontally connected to a base of a shaft attachment portion.

There is a need for an improved golf club construction that provides greater ability to alter the physical attributes of the golf club head by including removable components.

SUMMARY OF THE INVENTION

The present invention is directed to modular golf clubs. The inventive golf club includes a multi-component construction that includes a removable face component.

In an embodiment, a golf club head comprises a body, a face member, a top line key, and a threaded fastener. The body includes a recess having a heel side wall, a toe side wall, and a sole side wall defining a face support slot that is opened to a top line portion of the body. The body defines a threaded bore in a toe portion of the body. The face member is disposed in the face support slot and defines a ball striking surface. A plurality of score lines are recessed into the face member from the ball striking surface. The top line key forms a portion of a top line of the golf club head and extends in a heel to toe direction. The top line key defines an aperture in a toe portion of the top line key that aligns with the threaded bore of the body. The threaded fastener extends through the aperture of the top line key and is threaded into the threaded bore of the body. The fastener extends through the top line key and into the body to couple the top line key to the body. The top line key closes the opening of the face support slot, so that the face member is circumscribed by the heel side wall, the toe side wall, the sole side wall and the top line key.

In another embodiment, a golf club head comprises a body, a face member, a top line key, and a threaded fastener. The body includes a recess having a heel side wall, a toe side wall, and a sole side wall defining a face support slot that is opened to a top line portion of the body. The body defines a threaded bore in a toe portion of the body. The face member is disposed in the face support slot and defines a ball striking surface. A plurality of score lines are recessed into the face member from the ball striking surface. The top line key forms a portion of a top line of the golf club head and extends in a heel to toe direction. The top line key defines an aperture in a toe portion of the top line key that aligns with the threaded bore of the body. The threaded fastener extends through the aperture of the top line key and is threaded into the threaded bore of the body. The fastener extends through the top line key and into the body to couple the top line key to the body. The top line key closes the opening of the face support slot, so that the face member is circumscribed by the heel side wall, the toe side wall, the sole side wall and the top line key. The heel side wall of the recess defines an undercut, the toe side wall of the recess defines an undercut, and the face member includes rails on a heel side and a toe side that are disposed in the undercuts. The face member includes a rail on a sole side that is disposed in an undercut in the sole side wall of the recess, and the face member includes a rail on a top line side that is disposed in an undercut defined by the top line key.

In another embodiment, a golf club head comprises a body, a face member, a top line key, and a threaded fastener. The body includes a recess having a heel side wall, a toe side wall, and a sole side wall defining a face support slot that is opened to a top line portion of the body. The body defines a threaded bore in a toe portion of the body. The face member is disposed in the face support slot and defines a ball striking surface. A plurality of score lines are recessed into the face member from the ball striking surface. The top line key forms a portion of a top line of the golf club head and extends in a heel to toe direction. The top line key defines an aperture in a toe portion of the top line key that aligns with the threaded bore of the body. The threaded fastener extends through the aperture of the top line key and is threaded into the threaded bore of the body. The fastener extends through the top line key and into the body to couple the top line key to the body. The top line key closes the opening of the face support slot, so that the face member is circumscribed by the heel side wall, the toe side wall, the sole side wall and the top line key. The top line key includes a projection on a heel end of the top line key that is received in an undercut disposed in a top line portion of the body. The top line key includes a keyed surface on a heel end of the top line key that abuts a keyed surface on the top line portion of the body, and the abutment between the keyed surfaces prevents relative motion between the heel end of the top line key and a heel portion of the body in a face to rear direction.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
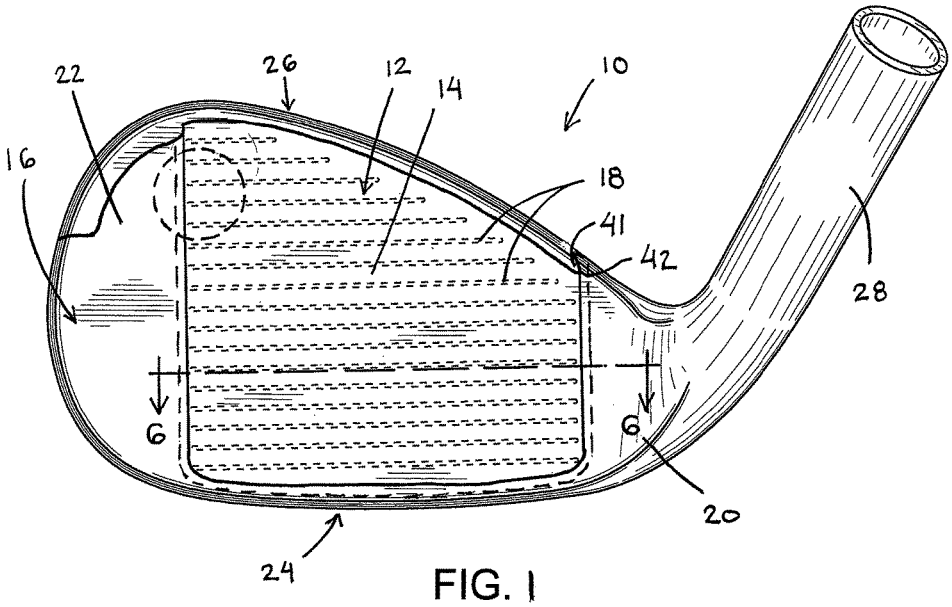
FIG. 1 is a front view of a golf club head in accordance with the present invention.
Figure 2:
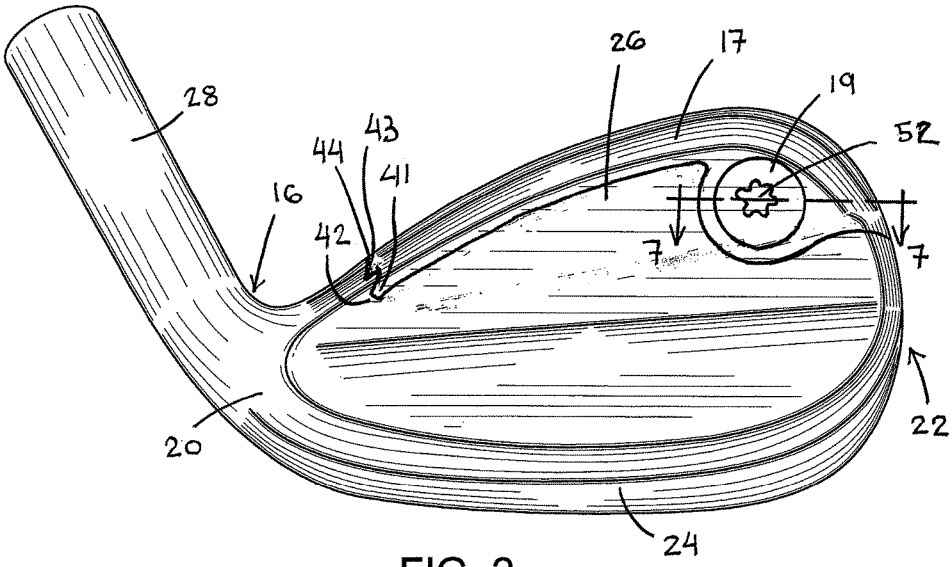
FIG. 2 is a rear view of the golf club head of FIG. 1.
Figure 3:
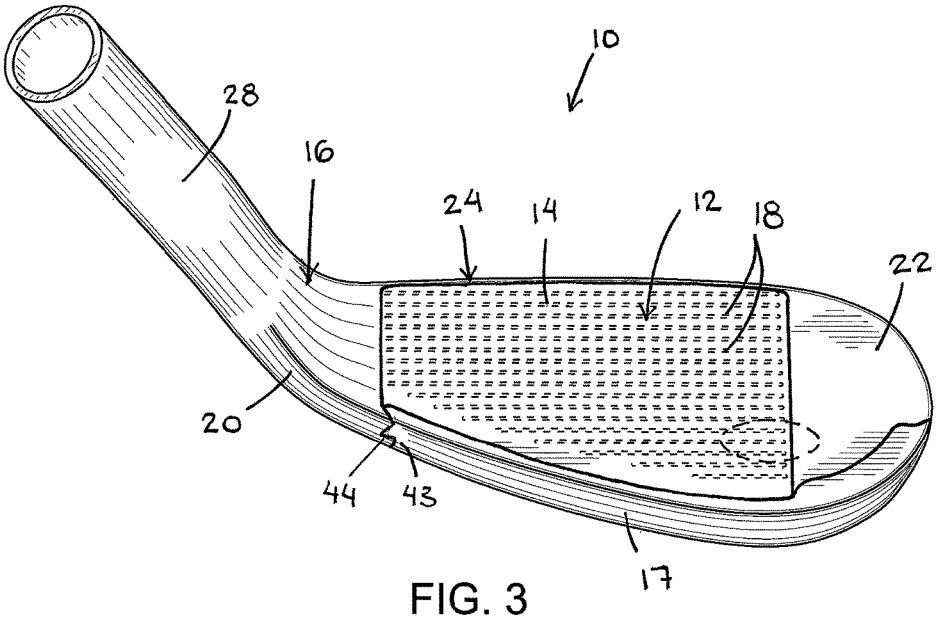
FIG. 3 is a top view of the golf club head of FIG. 1.
Figure 4:
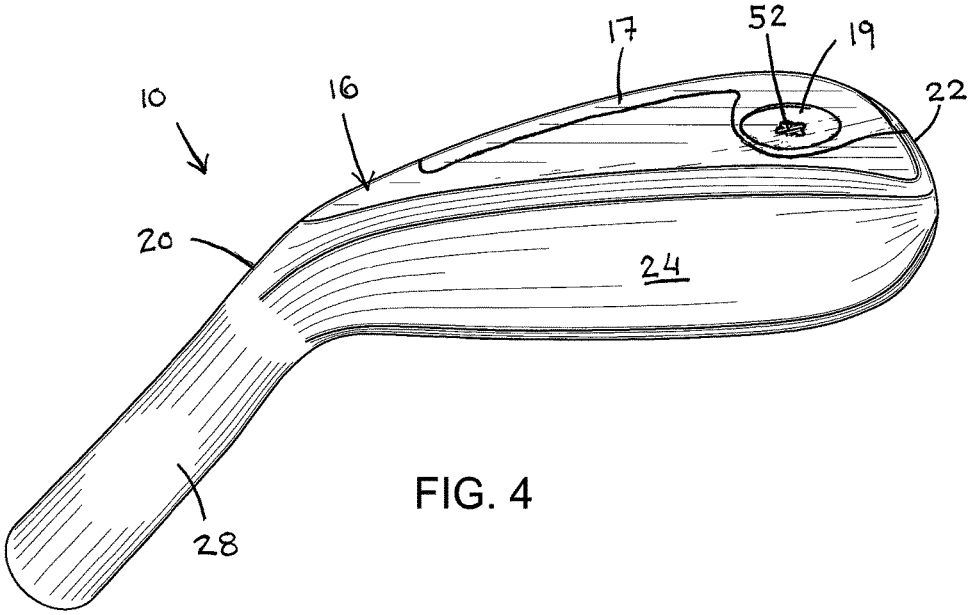
FIG. 4 is a bottom view of the golf club head of FIG. 1.
Figure 5:
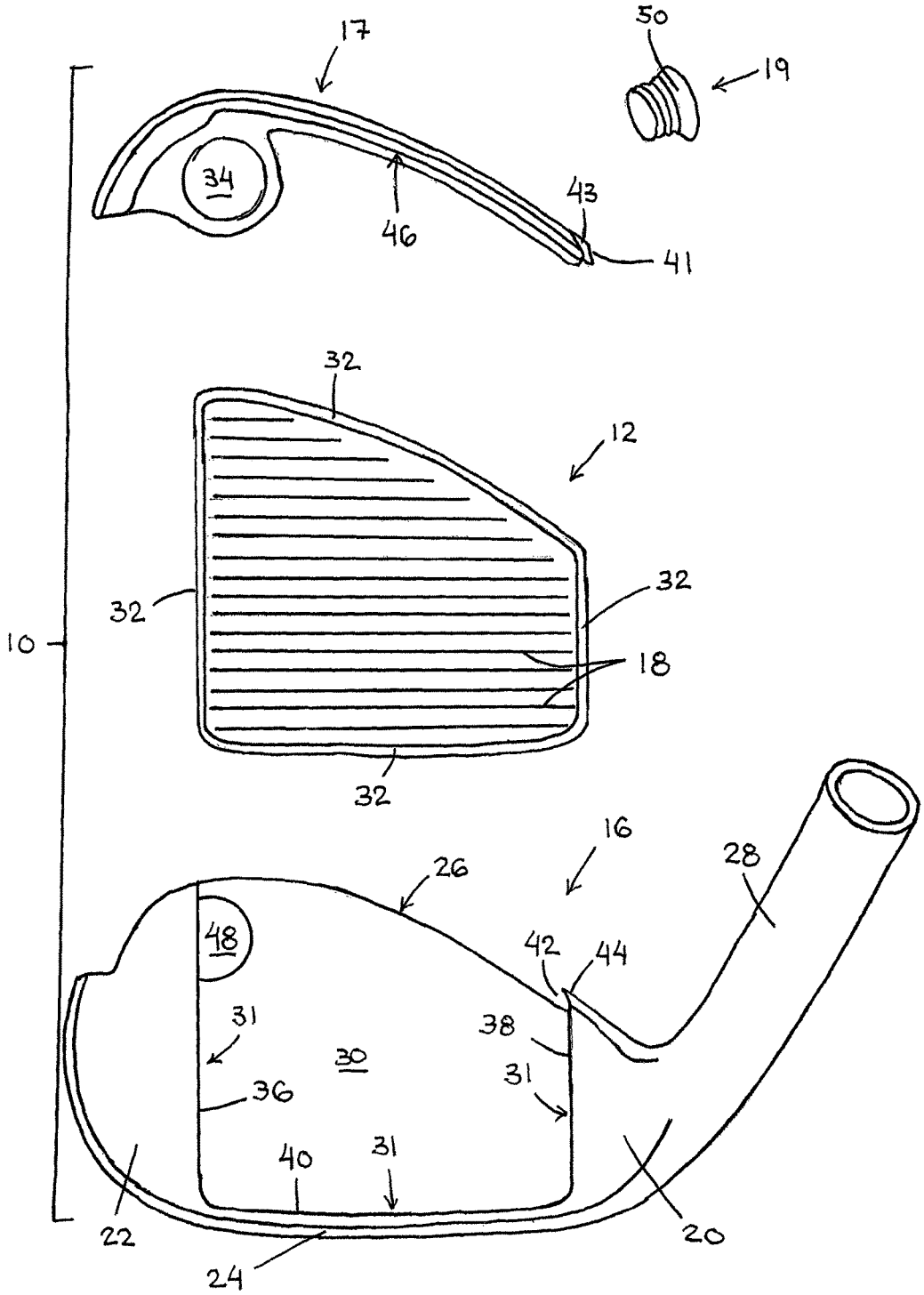
FIG. 5 is a front exploded view of the golf club head of FIG. 1.

The present invention is directed to modular golf clubs. In particular, the inventive golf clubs generally include a multi-component structure that allows various attributes to be altered. In an aspect of the present invention, the multi-component structure allows a face member to be replaced to alter, at least in part, mass properties, materials, visual attributes, surface texture, and/or scoreline geometry.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Referring to FIGS. 1-7, a golf club head 10 having an iron-type construction, and more particular a wedge-type construction, that includes a removable face member will be described. The golf club head generally includes a face member 12 and a body 16 that supports the face member 12, a top line key 17 and a fastener 19. The face member 12 includes a generally planar ball striking surface 14 and a plurality of score lines 18, or grooves, a rear surface and a side wall that extends between the ball striking surface 14 and the rear surface 15. The score lines 18 extend into the face member 12 from the ball striking surface 14. The score lines 18 assist in imparting spin to a golf ball during impact and may have various configurations to produce desired spin characteristics. A portion of the body 16 forms a hosel 28 for attaching a golf club shaft when the head is assembled into a golf club.

The body 16 provides the majority of the mass of club head 10 and is configured to distribute the mass so that club head has a desired behavior during impact with a golf ball and/or the ground during a swing. However, the total mass and the distribution of the mass of the golf club head 10 may be altered by selecting the material and/or geometry of the face member 12 and/or fastener 19 of the present invention. For example, a selection of fasteners 19 having different masses may be provided and used to compensate for grips and/or shafts having different masses, while maintaining the overall mass of the golf club. The body 16 may have a muscle-back or a cavity-back configuration so that the forgiveness and playability may be tuned. As shown, body 16 has a muscle-back configuration, but it should be appreciated that it may alternatively have a cavity-back configuration that provides perimeter weighting to increase the moment of inertia of the club head to add forgiveness during misaligned ball impacts. The mass of body 16 is concentrated below the geometric center in a sole portion 24.

Figure 6:
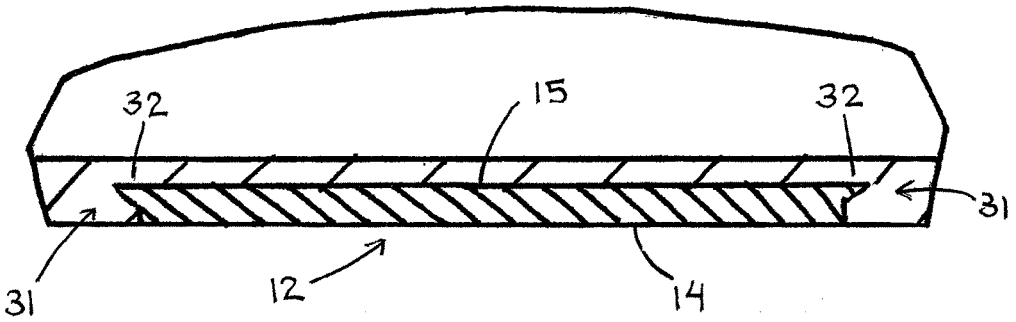
FIG. 6 is a cross-sectional view of a portion of the golf club head of FIG. 1, corresponding to line 6-6 shown in FIG. 1.

The body 16 also includes a face support slot 30 that is recessed into a front surface of the body 16. The face support slot 30 intersects a top line portion 26 of the body 16 so that the slot is open toward the front of the golf club head and toward the top line portion 26. In the present embodiment, the face support slot 30 defines a toe side wall 36, a heel side wall 38, and a sole side wall 40. The side walls of the face support slot 30 include lateral undercuts 31. The undercuts 31 are sized and shaped to receive rails 32 that are included on the perimeter of the face member 12, as shown in FIG. 6.

The opening of the face support slot 30 at the top of the club head body 16 allows the face member 12 to be slid into the face support slot 30 from the top of the golf club head toward the sole. The rails 32 included on the heel and toe sides of the face member 12 slide into the undercuts 31 included on the heel and toe side walls 36, 38 of the face support slot 30 until a sole side of the face member 12 abuts the sole side wall 40 of the face support slot 30. Preferably, the sole side wall 40 of the face support slot 30 includes an undercut 31 that receives a rail 32 included on the sole side of the face member 12. In the illustrated embodiment, the undercuts 31 are shaped so that the face support slot 30 is generally formed as a shallow and wide dovetail slot. In other words, the undercuts are generally triangular in shape and tapered so that they extend deeper into the side walls further to the rear of the club head body 16. The tapered shape of the undercuts 31 prevent movement of the face member 12 relative to the club head body 16 in heel to toe and front to back directions when the face member is installed. It should be appreciated that the undercuts and rails need not be tapered, and may be formed as stepped shoulders on the face member and stepped undercuts in the side walls of the face support slot.

As described above the face support slot is opened to the top of the club head body 16 and the face member 12 is slid into the face support slot 30 from the top. After the face member 12 is slid into the face support slot 30, the top line key 17 is coupled to the body 16 to retain the face member 12 in the face support slot 30. In that configuration, the face member 12 is bound by the face support slot 30 and the top line key 17, but the front ball striking surface 14 remains exposed.

The top line key 17 is removably affixed to the body 16 to retain the face member 12 in the face support slot 30. The top line key 17 forms a portion of a top line of the golf club head 10 and extends from a heel side of the face support slot 30 to a toe side of the face support slot 30. The heel side of the top line key 17 includes a projection 41 and a keyed surface 43 that complement and engage an undercut 42 and a keyed surface 44 of the body 16 disposed in a heel portion 20 of the body 16. The interaction between the projection 41 and the undercut 42 prevent the heel end of the top line key 17 from separating from the body 16 in an upward direction while allowing the toe end of the top line key 17 to slide into position in a toe to heel direction, and to slightly rotate down toward body 16 into a position that allows the fastener 19 to be installed. Similarly, the keyed surface 43 of the top line key 17 engages the keyed surface 44 of the body 16 to prevent the top line key 17 from moving relative to the body 16 in a forward to back (i.e., face to rear) direction while allowing the top line key 17 to be slid in a toe to heel direction during installation.

Additionally, the top line key 17 includes an aperture 34 at a toe side that receives fastener 19 and is used to lock the top line key 17 into a position that retains the face member 12. The aperture 34 is a through bore disposed on the toe end of the top line key 17. The aperture 34 is positioned so that when the top line key 17 is installed on the body 16, the aperture 34 aligns with a threaded fastener bore 48 disposed in the toe portion 22 of the body 16. The top line key 17 may also include an undercut 46 similar to the undercuts 31 of the body 16. The undercut 46 of the top line key aligns with, and receives, a rail 32 included on the upper perimeter of the face member 12 when the top line key 17 is installed.

Figure 7:
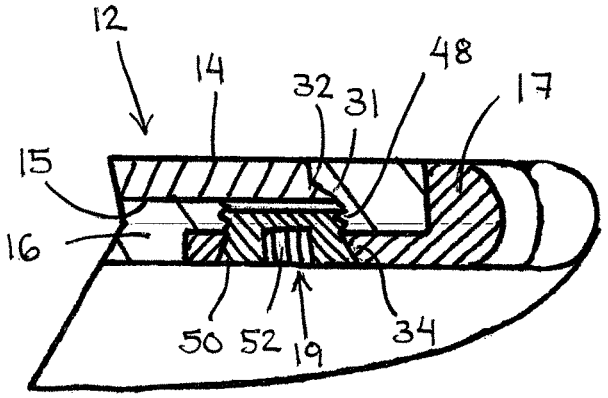
FIG. 7 is a cross-sectional view of a portion of the golf club head of FIG. 1, corresponding to line 7—shown in FIG. 2.

After the face member 12 is slid into the face support slot 30 and the top line key 17 is installed, the fastener 19 is inserted into the aperture 34 and threaded into the threaded fastener bore 48 of the body 16, as shown in FIG. 7. A tool that engages a tool engagement feature 52 on the head of the fastener 19 is used to install the fastener 19. Threading the fastener 19 into the body 16 fully locks the top line key 17, face member 12 and body 16 to each other so that the golf club head 10 is fully assembled.

Various features may be included in the construction so that the components are forced together during assembly. For example, the fastener 19 may include a tapered head 50. The face member 12 may be dimensioned so that as fastener 19 is threaded into the threaded fastener bore 48 the tapered abutment between the fastener head 50 and the aperture 34 of the top line key 17 draw the top line key toward the sole and tightly against the top edge of the face member 12. In addition, or as an alternative, an elastic material may be interposed between the face member 12 and the body 16 at the interaction locations between the rails 32 of the face member 12 and the undercuts of the body 16 and/or top line key 17. The elastic material is configured so that it is compressed during the assembly of the components to prevent relative movement between the components after assembly. It should be appreciated that the elastic material may be included as discrete pads or continuous filling at the rail/undercut interfaces. It should further be appreciated that the threaded fastener and the threaded fastener bore may be replaced with alternative fasteners, such as a quarter-turn fastener.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

We claim:

1. A golf club head, comprising:

a body including a recess having a heel side wall, a toe side wall, and a sole side wall defining a face support slot that is opened to a top line portion of the body, wherein the body defines a threaded bore in a toe portion of the body;

a face member disposed in the face support slot and defining a ball striking surface, wherein a plurality of score lines are recessed into the face member from the ball striking surface;

a top line key that forms a portion of a top line of the golf club head and extends in a heel to toe direction, wherein the top line key defines an aperture in a toe portion of the top line key that aligns with the threaded bore of the body; and a threaded fastener that extends through the aperture of the top line key and is threaded into the threaded bore of the body, wherein the fastener extends through the top line key and into the body to couple the top line key to the body, and wherein the top line key closes the opening of the face support slot, so that the face member is circumscribed by the heel side wall, the toe side wall, the sole side wall and the top line key.

2. The golf club head of claim 1, wherein the heel side wall of the recess defines an undercut, wherein the toe side wall of the recess defines an undercut, and wherein the face member includes rails on a heel side and a toe side that are disposed in the undercuts.

3. The golf club head of claim 2, wherein the face member includes a rail on a sole side that is disposed in an undercut in the sole side wall of the recess.

4. The golf club head of claim 2, wherein the face member includes a rail on a top line side that is disposed in an undercut defined in the top line key.

5. The golf club head of claim 2, wherein the undercuts on the heel side wall and the toe side wall are tapered so that the face support slot is a dovetail slot.

6. The golf club head of claim 1, wherein the top line key includes a projection on a heel end of the top line key that is received in an undercut disposed in the top line portion of the body.

7. The golf club head of claim 1, wherein the top line key includes a keyed surface on a heel end of the top line key that abuts a keyed surface on the top line portion of the body, wherein the abutment between the keyed surfaces prevents relative motion between the heel end of the top line key and a heel portion of the body in a face to rear direction.

8. The golf club head of claim 1, wherein the fastener includes a tapered head that abuts a side wall of the aperture of the top line key.

9. The golf club head of claim 1, further comprising elastic material interposed between at least one side of the face member and at least one side wall of the recess in the body.

10. The golf club head of claim 9, wherein the elastic material is disposed between a rail included on the face member and an undercut included in a side wall of the recess.

11. A golf club head, comprising:

a body including a recess having a heel side wall, a toe side wall, and a sole side wall defining a face support slot that is opened to a top line portion of the body, wherein the body defines a threaded bore in a toe portion of the body;

a face member disposed in the face support slot and defining a ball striking surface, wherein a plurality of score lines are recessed into the face member from the ball striking surface;

a top line key that forms a portion of a top line of the golf club head and extends in a heel to toe direction, wherein the top line key defines an aperture in a toe portion of the top line key that aligns with the threaded bore of the body; and a threaded fastener that extends through the aperture of the top line key and is threaded into the threaded bore of the body, wherein the fastener extends through the top line key and into the body to couple the top line key to the body, wherein the top line key closes the opening of the face support slot, so that the face member is circumscribed by the heel side wall, the toe side wall, the sole side wall and the top line key, wherein the heel side wall of the recess defines an undercut, wherein the toe side wall of the recess defines an undercut, wherein the face member includes rails on a heel side and a toe side that are disposed in the undercuts, wherein the face member includes a rail on a sole side that is disposed in an undercut in the sole side wall of the recess, and wherein the face member includes a rail on a top line side that is disposed in an undercut defined by the top line key.

12. The golf club head of claim 11, wherein the undercuts on the heel side wall and the toe side wall are tapered so that the face support slot is a dovetail slot.

13. The golf club head of claim 11, wherein the top line key includes a projection on a heel end of the top line key that is received in an undercut disposed in the top line portion of the body.

14. The golf club head of claim 11, wherein the top line key includes a keyed surface on a heel end of the top line key that abuts a keyed surface on the top line portion of the body, wherein the abutment between the keyed surfaces prevents relative motion between the heel end of the top line key and a heel portion of the body in a face to rear direction.

15. The golf club head of claim 11, wherein the fastener includes a tapered head that abuts a side wall of the aperture of the top line key.

16. The golf club head of claim 11, further comprising elastic material interposed between at least one side of the face member and at least one side wall of the recess in the body.

17. The golf club head of claim 16, wherein the elastic material is disposed between a rail included on the face member and an undercut included in a side wall of the recess.

18. A golf club head, comprising:

a body including a recess having a heel side wall, a toe side wall, and a sole side wall defining a face support slot that is opened to a top line portion of the body, wherein the body defines a threaded bore in a toe portion of the body;

a face member disposed in the face support slot and defining a ball striking surface, wherein a plurality of score lines are recessed into the face member from the ball striking surface;

a top line key that forms a portion of a top line of the golf club head and extends in a heel to toe direction, wherein the top line key defines an aperture in a toe portion of the top line key that aligns with the threaded bore of the body; and a threaded fastener that extends through the aperture of the top line key and is threaded into the threaded bore of the body, wherein the fastener extends through the top line key and into the body to couple the top line key to the body, wherein the top line key closes the opening of the face support slot, so that the face member is circumscribed by the heel side wall, the toe side wall, the sole side wall and the top line key, wherein the top line key includes a projection on a heel end of the top line key that is received in an undercut disposed in a top line portion of the body, wherein the top line key includes a keyed surface on a heel end of the top line key that abuts a keyed surface on the top line portion of the body, and wherein the abutment between the keyed surfaces prevents relative motion between the heel end of the top line key and a heel portion of the body in a face to rear direction.

19. The golf club head of claim 18, wherein the heel side wall of the recess defines an undercut, wherein the toe side wall of the recess defines an undercut, and wherein the face member includes rails on a heel side and a toe side that are disposed in the undercuts.

20. The golf club head of claim 19, wherein the undercuts on the heel side wall and the toe side wall are tapered so that the face support slot is a dovetail slot.

* * * * *